United States Patent [19]

Sasaki et al.

[11] Patent Number: 4,561,944

[45] Date of Patent: Dec. 31, 1985

[54] METHOD FOR PRODUCING SUPPORTS FOR LITHOGRAPHIC PRINTING PLATES

[75] Inventors: Hirokazu Sasaki; Akira Morita; Takemasa Yamamoto, all of Shizuoka, Japan

[73] Assignees: Fuji Photo Film Co., Ltd.; Nippon Light Metal Co., Ltd., both of Japan

[21] Appl. No.: 619,425

[22] Filed: Jun. 11, 1984

[30] Foreign Application Priority Data

Jun. 9, 1983 [JP] Japan ..... 58-101791

[51] Int. Cl.[4] ..... C25D 5/44; C25F 3/04

[52] U.S. Cl. ..... 204/33; 204/129.35; 204/129.4; 204/129.75; 204/DIG. 9; 204/129.43

[58] Field of Search ..... 204/129.35, 129.4, 129.43, 204/129.75, 33, DIG. 9; 428/687

[56] References Cited

U.S. PATENT DOCUMENTS

| | | | |
|---|---|---|---|
| 3,193,485 | 7/1965 | Vincent | 204/DIG. 9 |
| 4,229,266 | 10/1980 | Usbeck | 204/33 |
| 4,272,342 | 6/1981 | Oda et al. | 204/129.4 |
| 4,294,672 | 10/1981 | Ohba et al. | 204/129.4 |
| 4,297,184 | 10/1981 | Dyer | 204/DIG. 9 X |

*Primary Examiner*—Donald R. Valentine

*Attorney, Agent, or Firm*—Sughrue, Mion, Zinn, Macpeak, and Seas

[57] ABSTRACT

A method for producing a support for a lithographic printing plate is described, which comprises mechanically graining the surface of an aluminum sheet, and then electrolytically graining the surface of the aluminum sheet in a solution containing hydrochloric acid, nitric acid, or a mixture thereof by applying thereto an alternating current in such manner that the ratio the quantity of electricity during the cathodic period to the quantity of electricity anodic period is in the range of from 1.0/1 to 2.5/1.

5 Claims, 1 Drawing Figure

(a)
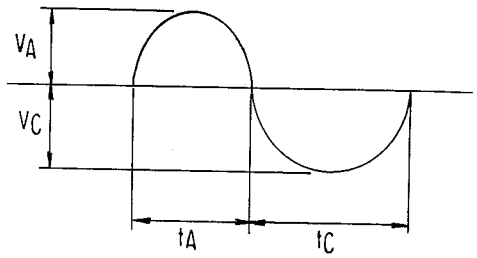
(b)
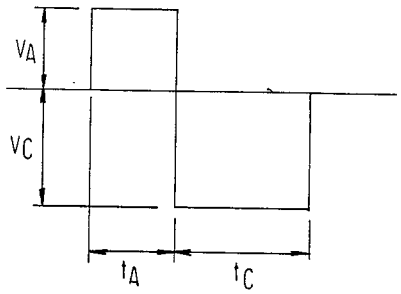
(c)
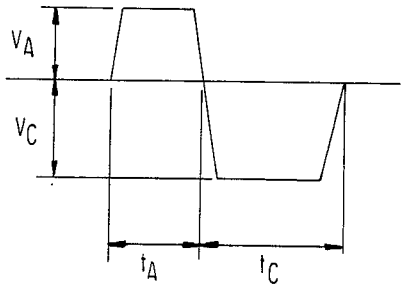

METHOD FOR PRODUCING SUPPORTS FOR LITHOGRAPHIC PRINTING PLATES

FIELD OF THE INVENTION

This invention relates to a method of producing supports for lithographic printing plates and, more particularly, to a method of producing grained aluminum sheet (e.g., plates) for lithographic printing plates.

BACKGROUND OF THE INVENTION

In order to use aluminum sheets as supports for lithographic printing plates, the surfaces of the aluminum sheets are usually roughened for improving the adhesion with photosensitive layers formed thereon and also improving the water retensivity thereof. The roughening treatment is usually called "graining" and this treatment is inevitably required in the production of supports for lithographic printing plates; furthermore, considerable operation skill has been required for performing this treatment.

Graining for aluminum sheet is generally classified into mechanical graining such as ball graining, wire graining, brush graining, etc., and electrolytic graining, usually referred to as electrochemical etching. Ball graining requires skill factors for selecting the materials of ball, the kind of abrasives, the control of the amount of water during polishing, etc.; also, it is difficult to perform continuous ball graining treatment, or, in other words, each sheet must be finished by an individual, discontinuous, treatment. The employment of wire graining results in non-uniform grains. On the other hand, brush graining can overcome these difficulties, but has such faults that the grains formed are generally simple and shallow, rotary brush patterns remain on the surface of aluminum sheets thus brush grained, sometimes some directional property appears for grains formed, and non-image areas are apt to be stained.

An electrolytic graining treatment can provide uniform grains having large mean roughness as compared to conventional mechanical graining methods such as ball graining, brush graining, etc., by properly selecting the electrolytic conditions, but the conditions are restricted very severely. In more detail, if various conditions such as the composition and temperature of the electrolytes, the electrolytic conditions, wetc., are kept constant, products having constant qualities are easily obtained, but these electrolytic conditions are very severe and it is very difficult to control these conditions within proper ranges. Furthermore, when the surfaces of aluminum sheets are grained by an electrolytic graining treatment, there is an economical problem in that a large amount of electric power is consumed, and hence the cost for the electric power in the production costs for lithographic printing plates becomes very high. Moreover, in the electrolytic graining treatment, the waste electrolyte used in the electrolytic treatment contains a considerable amount of aluminum ions, and hence the personal expense as well as the cost for chemicals required for the treatment of the waste solution becomes very high.

As a means for somewhat overcoming these difficulties, a method of producing supports for lithographic printing plates is disclosed in Japanese Patent Publication (OPI) No. 123204/78 in which an aluminum sheet grained by brush graining is further grained by alternating current electrolytic graining at a quantity of electricity of 2,000 coulombs or less in an acid electrolyte, thereby obtaining a superimposed grained surface by the combination of brush graining and electrolytic graining applied to the surface of the aluminum sheet.

However, it has been found that in such a superimposed graining method including brush graining and electrolytic graining, when the electrolytic graining step practically disclosed in the specification of the abovementioned patent publication is practiced that is, when the electrolytic graining treatment is practiced in an electrolyte containing hydrochloric acid as the main component using a sinusoidal symmetrical alternating current whose potential at anodic period is equal to that at cathodic period and whose quantity of electricity during the anodic period is equal to that during the cathodic period, the saving on consumed electric power may be achieved as compared with the case of graining the surface of an aluminum sheet by an electrolytic graining treatment only, but practically the properties of the aluminum sheet as supports for lithographic printing plates are not improved.

SUMMARY OF THE INVENTION

In order to overcome the foregoing problems, the inventors have conducted extensive investigations on finding an improved graining method for the surfaces of aluminum sheets which can not only achieve the economy of consumed electric power but also improve the properties of aluminum sheets, as the result thereof the inventors have finally discovered the method of this invention. That is, the present invention provides a method for producting supports for lithographic printing plates which comprises mechanically graining the surface of an aluminum sheet, and then electrolytically graining the surface of the aluminum sheet in a solution containing hydrochloric acid, nitric acid, or a mixture thereof by applying an unsymmetrical alternating current in such manner that the ratio of the quantity of electricity during the cathodic period to the quantity of electricity during the anodic period is from 1.0/1 to 2.5/1. Preferably 300 coulombs/$dm^2$ or less electricity is applied during the anodic period.

BRIEF DESCRIPTION OF THE DRAWINGS

The FIGURE shows a voltage wave form of an electric current obtained as the alternating wave-form electric current used in the present invention, wherein (a) is a sine wave, (b) is a rectangular wave and (c) is a trapezoidal wave.

DETAILED DESCRIPTION OF THE INVENTION

The term "aluminum sheets" used herein includes not only pure aluminum sheets but also aluminum alloy sheets. Examples of aluminum alloys used as the aluminum sheets in this invention include alloys of aluminum and one or more other metals, such as silica, copper, manganese, magnesium, chromium, zinc, lead, bismuth, nickel, etc.

It is generally practiced to remove a rolling oil attached to the surface of an aluminum sheet or pre-treat the surface of an aluminum sheet to provide a clean aluminum surface prior to conducting mechanical graining on the surface of the aluminum sheet. For removing a rolling oil from the surface of an aluminum sheet, a solvent such as trichloroethylene, etc., or a surface active agent is usually used. Also, for the abovementioned pre-treatment for the aluminum surface, an alkali etching agent such as sodium hydroxide, potassium hydroxide, etc., is widely used.

However, according to this invention, the pretreatment which is practiced in conventional techniques prior to mechanical graining of the surfaces of the aluminum sheets can be omitted, except in the case that a very large amount of a rolling oil remains on the surfaces of the aluminum sheets to be grained.

In the method of this invention, any desired mechanical graining may be employed, but brush graining is preferably used in the industrial practice of this invention.

Brush graining is described in detail in Japanese Patent Publication No. 46003/76 (corresponding to U.S. Pat. No. 3,891,516) and U.S. Application Ser. No. 284,851 filed Aug. 30, 1972, now abandoned. It is preferred that the mechanical graining is applied that the mean central line roughness (Ra) is from 0.4 to 1.0 micron. The mean central line roughness (Ra) of the grain is the value obtained by the following equation (I), expressed in micron units, when the measurement length l is drawn out from the roughness curve shown by JIS-B 0601-1970 to a direction of the central line, and the roughness curve is shown by $y=f(x)$, the central line of the drawn out portion being taken as X-axis and the direction perpendicular thereto being taken as Y-axis.

$$Ra = \frac{1}{l} \int_0^l f(x)dx$$

The extent of mechanical graining for obtaining Ra in the above-described range can be easily determined once the conditions for the electrolytic graining treatment applied thereafter, and for additional treatment, if any is employed, are determined.

The aluminum sheet mechanically grained is then electrochemically grained, but it is preferred to apply chemical etching to the surface of the aluminum sheet thus mechanically grained prior to electrolytic graining. The chemical etching treatment has an action of removing abrasives and fine aluminum scraps embedded in the surface of an aluminum sheet and by employing chemical etching, electrolytic graining can then be uniformly and more effectively applied on the surface of the aluminum sheet. Such a chemical etching method is described in detail, for example, in U.S. Pat. No. 3,834,998. More particularly, for performing chemical etching, an aluminum sheet mechanically grained is immersed in an aqueous solution of an acid or a base. Examples of the acid used for the purpose are sulfuric acid, persulfuric acid, hydrofluoric acid, phosphoric acid, nitric acid, hydrochloric acid, etc., and examples of the base are sodium hydroxide, potassium hydroxide, sodium tertiary phosphate, potassium tertiary phosphate, sodium aluminate, sodium metasilicate, sodium carbonate, etc. However, the use of an aqueous solution of the above-mentioned bases is particularly preferred since in such case a high etching speed is obtained.

In general, chemical etching be effected by treating with a 0.05 to 40 wt% aqueous solution of these acids or alkalis at liquid temperatures of from 40° to 100° C. for from 5 to 300 seconds; prticularly preferred is etching at 5 to 15 g/m$^2$. With the etching amount of less than 5 g/m$^2$, it is difficult to improve staining tendency at the non-image areas, and conversely with the etching amount of more than 20 g/m$^2$, the amount of aluminum ions contained in a waste liquid is too large so that the system becomes industrially ineconomical. When the etching amount is maintained in this range, the disadvantages that printing press life is reduced as compared to a support having an etching amount of less than 5 g/m$^2$, fine dots of approximately 1 to 5% cannot be reproduced, etc. are encountered, but such disadvantages can be repaired by a electrolytic surface roughening treatment later described.

In the case of performing the aforesaid chemical etching using an aqueous solution of a base, smut is generally formed on the surface of the aluminum; in this case, it is preferred that the smut-formed surface be subjected to a treatment, a so-called desmutting treatment, with phosphoric acid, nitric acid, sulfuric acid, chromic acid, or a mixed acid containing two or more acids as described above.

The thus treated aluminum plate is subsequently subjected to the electrolytic surface roughening treatment. This treatment should be performed by applying an unsymmetrical alternating waveform electric current between the aforesaid aluminum plate and its appropriate opposing terminal such as a black lead material, an aluminum plate, etc., in an aqueous solution containing hydrochloric acid, nitric acid or a mixture thereof such that the ratio of the quantity of electricity with the plate as a cathode (hereafter referred to as Qc) to the quantity of electricity with the plate as an anode (hereafter referred to as Qa) is in the range of from 1.0/1 to 2.5/1, preferably from 1.0/1 to 2.0/1. In this case, it is preferred that Qa be in a range not exceeding 300 coulombs/dm$^2$.

In the prior art, it is said to be preferable that the ratio of Qc to Qa be in the range of from 0.3/1 to 0.95/1, as described in Japanese Patent Application (OPI) No. 137993/80 and British Pat. No. 2,047,274. Further, it is disclosed in Japanese Patent Publication No. 19280/81 and U.S. Pat. No. 4,087,341 that the ratio of Qc to Qa is preferably in the range of from 0.3/1 to 0.8/1, and when the ratio of Qc to Qa exceeds 1, graining becomes uneven.

However, as a result of extensive investigations, the present inventors have discovered that by increasing the quantity electricity with the plate as a cathode to the quantity of electricity with the plate as an anode, and by combining it with a mechanical roughening tratment, lithographic printing plates having improved staining in the non-image areas in printing, and having excellent printing press life, are obtained.

Further, it is surprising that a uniformly grained surface can be formed by reducing the electricity used for electrochemical surface toughening.

However, when the Qc/Qa is set forth at more than 2.5/1, not only is no uniformly grained surface formed, but energy efficiency decreases.

To the contrary, in the case that electrolytic surface roughening treatment is performed in accordance with the process described in Japanese Patent Publication No. 28123/73 or British Pat. No. 896,563, the object of the present invention is not achieved since the symmetrical alternating electric current is used and accordingly, excellent supports for lithographic printing plates cannot be obtained.

The wave form of the alternating current used in this invention is a wave form obtained by alternately changing the positive and negative polarities thereof and any unsymmetrical alternating current showing the wave form wherein Qc is equal to or larger than Qa can be employed in this invention. The desirable ratio of Qc/Qa is in the range of from 1.0/1 to 2.5/1. A preferred alternating current giving such a wave form is the alternating current wherein the voltage during the anodic period (Va) is lower than the voltage during the cathodic period (Vc). Typical examples of the preferred voltage wave forms are shown in the FIGURE in which (a) shows a sine wave, (b) shows a rectangular wave, and (c) shows a trapezoidal wave.

It is important that the anodic period of time ($t_A$ in the FIGURE) be set to be shorter than the cathodic period of time ($t_c$ in the FIGURE) and by properly changing the Qc/Qa ratio provided by controlling voltage, the forms (the diameter, depth, etc., of pores) of the porous surface to be formed can be desirably controlled. Preferred ratio of $t_A/t_c$ ranges from 1:1.05 to 105 and most peferably 1:1.5 to 1:4. In more detail, aluminum sheets having grained surfaces whose pore diameters (pit diameters) are 1 to 20 microns, pore depths are 1 to 10 microns, and central line mean roughness (Ra) are 0.2 to 2 microns can be obtained. If a direct current or an ordinary alternating current is used, it is impossible to change the structure of grains formed by electrolytic graining.

Thus, by applying the electrolytic graining treatment by the above-mentioned alternating current to the surface of an aluminum sheet mechanically grained, lithographic printing plates possessing excellent water retentivity, the characteristic that the non-image area is hardly contaminated, and a preferred white base color, are obtained.

As the suitable electrolytic bath used in this invention, an aqueous solution of hydrochloric acid or a salt thereof, nitric acid or a salt thereof, or a mixture thereof can be used. Furthermore, if desired, the electrolytic bath may further contain amines, etc., as described in U.S. Pat. No. 3,755,116; sulfuric acid as described in Japanese Patent Publication (OPI) No. 57902/74; boric acid as described in U.S. Pat. No. 3,980,539; and phosphoric acid as described in West German Patent Publication (OLS) No. 2,250,275.

The concentration of the electrolyte used in the electrolytic graining is in the range of from 0.1 to 4% by weight. Also, the voltages Va and Vc suitable for forming desired structures are preferably in the rang of from 5 to 50 volts. Also, as was noted above, it is desirable that the ratio of Qc/Qa is in the range of from 1.0/1 to 2.5/1 and, in the range, Qa is 300 coulomb/dm$^2$ or less. If the value is higher than 300 coulombs/dm$^2$, the grain structure formed on the aluminum sheet is not uniform, and the non-image area is apt to be contaminated.

The aluminum sheet treated as described above can be used as is as a support for lithographic printing plates, but additional treatments such as an anodic oxidation treatment, a chemical treatment, etc., can be applied to the aluminum sheet.

The anodic oxidation treatment may be applied to the aluminum sheet treated as described above immediately washing the sheet with water but since smut forms on the surface of the aluminum sheet treated by the electrolytic graining, it is preferred to apply a desmutting treatment to the aluminum sheet to remove the smut. Such a desmutting treatment is carried out by brining the surface of the aluminum sheet into contact with an aqueous solution of an acid or alkali by, for example, a dipping treatment, etc.

Examples of the acid used for desmutting are phosphoric acid, sulfuric acid, chromic acid, etc., and examples of the alkali are those as described in connection with the chemical etching treatment which may be applied to the aluminum sheet after mechanical graining. The particularly preferred desmutting treatment is the method of contacting the aluminum sheet with an aqueous solution of from 15 to 65% by weight sulfuric acid at a temperature of from 50° to 90° C., as described in Japanese Patent Publication (OPI) No. 12739/78, and the alkali etching method as described in Japanese Patent Publication No. 28123/73.

The anodic oxidation treatment can be carried out by the manner conventionally practiced in the field of the art. Practically, by passing a direct current or an alternating current through the aluminum sheet in an aqueous solution or an non-aqueous solution of sulfuric acid, phosphoric acid, chromic acid, oxalid acid, benzenesulfonic acid, etc., or a combination of two or more acids, an anodic oxidation film or layer can be formed on the surface of the aluminum sheet.

The conditions for the anodic oxidation may vary according to the kind of the electrolyte employed, but in general, it is proper that the concentration of the electrolyte be from 1 to 80% by weight, the temperature from 5° to 70° C., the current density from 0.5 to 60 amps/dm$^2$, the voltage from 1 to 100 volts, and the electrolytic period of time from 30 seconds to 50 minutes.

Among these anodic oxidations, the method of performing an anodic oxidation in sulfuric acid at a high current density used in the invention described in U.K. Pat. No. 1,412,768 and the method of performing an anodic oxidation using phosphoric acid as the electrolytic bath described in U.S. ZPat. No. 3,511,661 are particularly preferred.

The aluminum sheet thus anodically oxidized may be further treated with an aqueous solution of an alkali metal silicate such as, for example, sodium silicate by a dipping method, etc., as described in U.S. Pat. Nos. 2,714,066 and 3,181,461 or a subbing layer of a hydrophilic cellulose (e.g., carboxymethyl cellulose, etc.) containing a water-soluble metal salt (e.g., zinc acetate, etc.) may be formed on the surface of the aluminum sheet as described in U.S. Pat. No. 3,860,426.

A photosensitive lithographic printing plate can be obtained by forming a conventionally known photosensitive layer on the support for lithographic printing plate thus prepared according to the method of this invention as a photosensitive layer for a presensitized printing plate and the lithograhic printing plate obtained by applying thereto a lithograhic plate-making treatment possesses excellent properties.

The compositions for the above-described photosensitive layer can include the following materials:

(1) Photosensitive layers comprising diazo resins and binders:

Preferred examples of diazo resins are described in U.S. Pat. Nos. 2,063,631 and 2,667,415, Japanese Patent Publication Nos, 18001/74, 45322/74 and 45323/74, British Pat, Nos. 1,312,925 and 1,023,589. Preferred examples of binders are described in British Pat. Nos. 1,350,521 and 1,460,978, U.S. Pat. Nos. 4,123,276, 3,751,257 and 3,660,097 and Japanese Patent Application (OPI) No. 98614/79.

(2) Photosensitive layers comprising an o-quinonediazide compounds:

Preferred o-quinonediazide compounds are o-naphthoquinonediazide compounds, and such are described, for example, in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443 as well as other many publications.

(3) Photosensitive layers comprising an azide compound and binder (polymer):

Examples of photosensitive compositions for such photosensitive layers include compositions comprising azide compounds and water-soluble or alkali-soluble polymers described, for example, in U.K. Pat. Nos. 1,235,281 and 1,495,861 and Japanese Patent Publication (OPI) Nos. 32331/76 and 3,6128/76 as well as the compositions comprising polymers having azide group and polymers as binders described in Japanese Patent Publication (OPI) Nos. 5102/75, 84302/75, 84303/75 and 12984/78. p (4) Othwer photosensitive resin layers:

Such layers include polyester compounds as disclosed, for example, in Japanese Patent Publication (OPI) No. 96696/77; polyvinyl cinnamate resins as described in U.K. Pat. Nos. 1,112,177, 1,313,390, 1,341,004 and 1,377,747; and photopolymerizable type photopolymer compositions as described in U.S. Pat. Nos. 4,072,528 and 4,072,527.

The amount of the photosensitive layer formed on the support is from about 0.1 to about 7 g/m$^2$, and preferably from 0.5 to 4 g/m$^2$.

Then, the effectiveness of the supports for lithographic printing plate will further be described in more detail based on the following examples.

EXAMPLE 1

After the surface of an aluminum sheet having a thickness of 0.24 mm was subjected to graining by a nylon brush in an aqueous dispersion of pumice of 400 mesh, it was thoroughly washed with water. Then, the aluminum plate was etched by dipping in a 10% aqueous solution of sodium hydroxide at 70° C. for 60 seconds followed by washing with running water. Thereafter the aluminum plate was neutralized with 20% $HNO_3$ and then washed with water.

The resulting plate was subjected to electrolytic surface roughening treatment by varying the Qc/Qa ratio and the quantity of electricity using the alternating wave-form electric current of the rectangular wave shown in (b) in the FIGURE under the condition of $V_A=9V$ and $t_A/t_3=3/7$. Further, for purposes of comparison, an aluminum plate was etched by dipping it in a 10% aqueous solution of sodium hydroxide at 70° C. for 60 seconds without subjecting it to any mechanical surface roughening treatment. After the aluminum plate was washed with running water, it was neutralized and washed with a 20% aqueous solution of nitric acid, and then again washed with water. Further, an electrolytic surface roughening treatment was performed under the condition of $Qc/Qa=2.0/1$, $Qa=2500$ coulomb/dm$^2$ and $Qc=300$ coulombs/dm$^2$ and the lower electricity quantity thereof, respectively, using the alternating wave-form electric current shown in (b) in the FIGURE.

The results are shown in Table 1.

Subsequently, each of the aluminum plates was desmutted by dipping in a 30% aqueous solution of $H_2SO_4$ at 55° C. for 2 minutes. Thereafter, anodic oxidation was performed so as to have a thickness of 3 g/m$^2$ in a 15% aqueous solution of $H_2SO_4$. On each of the resulting aluminum supports having the anodically oxidized layers, the following photosensitive layer was coated and dried to provide a photosensitive layer. Each of the photosensitive layers was coated at 2.5 g/m$^2$ on dry basis.

| | |
|---|---|
| Esterified compound of naphthoquinone-1,2-diazide-5-sulfonyl chloride and pyrogallol acetone resin (described in Example 1 in U.S. Pat. No. 3,635,709) | 0.75 g |
| Cresol Novolak Resin | 2.00 g |
| Tetrahydrophthalic Anhydride | 0.15 g |
| Oil Blue #603 (produced by Orient Chemical Co., Ltd.) | 0.04 g |
| o-Naphthoquinonediazide-4-sulfonic Acid Chloride | 0.04 g |
| Ethylene Dichloride | 16 g |
| 2-Methoxyethylacetate | 12 g |

Each of the thus prepared photosensitive lithographic printing plates was imagewise exposed to light for 30 seconds at a distance of 1 m using a Fuji Photo PS Light (Toshiba 3 killowatts metal halide lamp, MU 2000-2-OL type, sold by Fuji Photo Film Co., Ltd.), and it was then developed using a 5.26% aqueous solution (pH=12.7) of sodium silicate having a molar ratio $SiO_2/Na_2O$ of 1.74/1 followed by treatment with an aqueous solution of gum arabic of 14° Be.

Using the thus prepared lithographic printing plates, printing as performed in a conventional manner. The results are shown in Table 1.

TABLE 1

| Sample No. | Mechanical Roughening | Ratio of Qc/Qa | Anodic Quantity of Electricity Qa (coulomb/dm$^2$) | Printing Press Life (thousand) | Contamination in Non-Image Areas | Surface Roughness Ra (μ) | |
|---|---|---|---|---|---|---|---|
| 1 | positive | 0.5 | 100 | 50 | good | 0.6 | Comparison |
| 2 | positive | 1.0 | 100 | 100 | good | 0.6 | Invention |
| 3 | positive | 1.5 | 100 | 100 | good | 0.6 | Invention |
| 4 | positive | 2.0 | 100 | 100 | good | 0.6 | Invention |
| 5 | positive | 2.5 | 100 | 100 | good | 0.6 | Invention |
| 6 | positive | 3.0 | 100 | 100 | poor | 0.6 | Comparison |
| 7 | positive | 2.0 | 300 | 100 | good | 0.6 | Invention |
| 8 | positive | 2.0 | 500 | 100 | poor | 0.6 | Comparison |
| 9 | positive | 0.8 | 300 | 100 | poor | 0.6 | Comparison |
| 10 | negative | 2.0 | 2500 | 100 | poor | 0.6 | Comparison |
| 11 | negative | 2.0 | 300 | 50 | good | 0.3 | Comparison |

From the results shown in Table 1, it is understood that the lithographic printing plates using the supports wherein the mechanically roughened surface was subjected to the electrolytic surface roughening treatment under the conditions of a Qc/Qa ratio of from 1.0/1 to 2.5/1 and the quantity electrcity with the plate as an anode of less than 300 coulombs/$dm^2$.

While the invention has been described in detail and with reference to specific embodiments thereof, it will be apparent to one skilled in the art that various changes and modifications can be made therein without departing from the spirit and scope thereof.

What is claimed is:

1. A method for producing a support for a lithographic printing plate which comprises mechanically graining the surface of an aluminum sheet, and then electrolytically graining the surface of the aluminum sheet in a solution containing hydrochloric acid, nitric acid, or a mixture thereof by applying thereto an unsymmetrical alternating current in such manner that the ratio of the quantity of electricity during the cathodic period to the quantity of electricity during the anodic period is in the range of from 1.0/1 to 2.5/1 and the quantity of electricity during the anodic period is 300 coulombs/$dm^2$ or less.

2. A method for producing a support for a lithographic printing plate as in claim 1, wherein after the mechanical graining but prior to the electrolytic graining, the surface of the aluminum sheet is chemically etched.

3. A method for producing a support for a lithographic printing plate as in claim 2, wherein the chemical etching is carried out by immersing the aluminum sheet in an aqueous solution of an acid selected from the group consisting of sulfuric acid, persulfuric acid, hydrofluoric acid, phosphoric acid, nitric acid, and hydrochloric acid.

4. A method for producing a support for a lithographic printing plate as in claim 2, wherein the chemical etching is carried out by immersing the aluminum sheet in an aqueous solution of a base selected from the group consisting of sodium hydroxide, potassium hydroxide, sodium tertiary phosphate, sodium aluminate, sodium metasilicate, and sodium carbonate.

5. A method for producing a support for a lithographic printing plate as in claim 1, comprising the step of further anodizing th aluminum sheet after said electrolytic graining.

* * * * *